US006338544B1

(12) United States Patent
Drake et al.

(10) Patent No.: US 6,338,544 B1
(45) Date of Patent: Jan. 15, 2002

(54) REDUCTION OF STITCH JOINT ERROR BY ALTERNATING PRINT HEAD FIRING MODE

(75) Inventors: Donald J. Drake; David Mantell, both of Rochester; Mark Cellura; Juan Becerra, both of Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/342,535

(22) Filed: Jun. 29, 1999

(51) Int. Cl.[7] ..... B41J 2/145; B41J 2/15; B41J 2/205; B41J 29/38

(52) U.S. Cl. ..... 347/41; 347/9; 347/12

(58) Field of Search ..... 347/9, 11, 41, 347/40, 12

(56) References Cited

U.S. PATENT DOCUMENTS

| | | | | |
|---|---|---|---|---|
| 4,571,599 A | | 2/1986 | Rezanka | |
| 4,748,453 A | | 5/1988 | Lin et al. | |
| 4,999,646 A | * | 3/1991 | Trask | 347/11 |
| 5,192,959 A | | 3/1993 | Drake et al. | |
| 5,297,017 A | | 3/1994 | Haselby et al. | |
| 5,451,990 A | | 9/1995 | Sorenson et al. | 347/47 |
| 5,600,350 A | | 2/1997 | Cobbs et al. | 347/37 |
| 5,644,344 A | | 7/1997 | Haselby | 347/19 |
| 5,675,365 A | | 10/1997 | Beccerra et al. | 347/9 |
| 5,808,635 A | * | 9/1998 | Kneezel et al. | 347/41 |
| 5,917,520 A | * | 6/1999 | Koujiyama et al. | 347/41 |
| 5,923,345 A | * | 7/1999 | Imai | 347/11 |
| 5,992,962 A | * | 11/1999 | Yen et al. | 347/41 |

FOREIGN PATENT DOCUMENTS

| | | | |
|---|---|---|---|
| EP | 0 476 860 A | 3/1992 | B41J/2/205 |
| EP | 0 677 388 A2 | 10/1995 | B41J/2/155 |
| EP | 0677 388 A3 | 1/1996 | B41J/2/159 |
| JP | 56 089973 A | 7/1981 | B41J/3/20 |
| JP | 60 201772 A | 10/1985 | H04N/1/23 |
| JP | 09 131876 A | 5/1997 | B41J/2/05 |

* cited by examiner

*Primary Examiner*—John Barlow
*Assistant Examiner*—Alfred Dudding
(74) *Attorney, Agent, or Firm*—Oliff & Berridge, PLC

(57) ABSTRACT

An apparatus and method for forming an image with a print head that fires groups of drops of fluid results in a reduction in stitch joint error. The stitch joint error is reduced by changing the firing sequence of the nozzles of adjacent dies of the print head.

18 Claims, 6 Drawing Sheets

FIG. 2
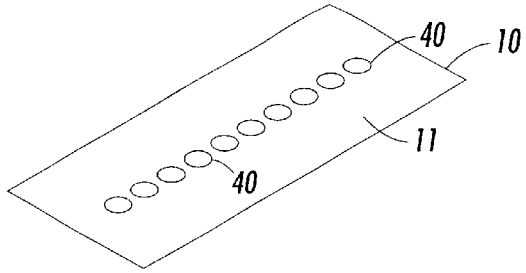
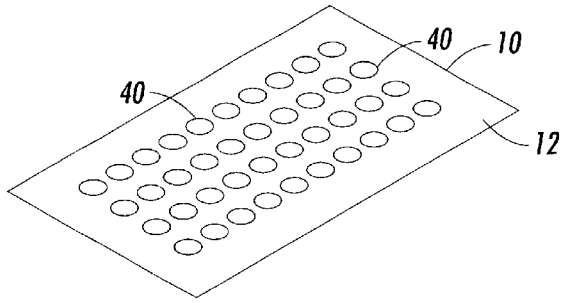
FIG. 3
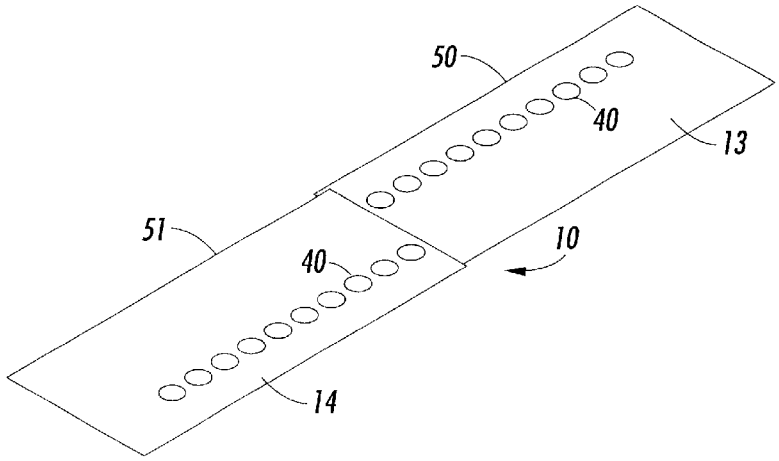
FIG. 4

REDUCTION OF STITCH JOINT ERROR BY ALTERNATING PRINT HEAD FIRING MODE

BACKGROUND OF THE INVENTION

1. Field of Invention

The invention relates to stitch errors in printing.

2. Description of Related Art

Fluid ejecting devices such as, for example, ink jet printers, fire drops of fluid from rows of nozzles of an ejection head. The nozzles are usually fired sequentially in groups beginning at one end of the head and continuing to the other end of the head. While the nozzles are being fired, the head moves at a rate designed to advance it by a resolution distance before the next firing sequence begins. If the nozzles are not fired simultaneously, the rows of nozzle are usually tilted so that drops fired from all nozzles land in a substantially vertical column. The ejection head can have one or more dies, each die having a plurality of nozzles. Some devices have ejection heads with only one die, and some devices have ejection heads with multiple dies. If an ejection head has multiple dies, the dies can be, for example, arranged vertically with respect to one another so that the head can eject more drops in a single swath of the head compared to a head having a single die.

The line at which the swaths ejected by adjacent dies, or at which the adjacent swaths, meet is called the stitch joint. Stitch joint error exists when the swaths meeting at the stitch joint meet in such a way that the resulting arrangement of drops at the stitch joint of a printed image is undesirable. Because the spacing of the stitch joint errors is typically ½ to 1 times the printing width of the print head (typically ¼" to ½"), the stitch joint errors are very noticeable because the human eye is very sensitive to this spatial frequency region.

Stitch joint error can be, for example, the result of a gap between the drop of one die adjacent the stitch joint and the drop of an adjoining die adjacent the stitch joint. Such a gap can be the result of the same firing sequence being used for the nozzles of both dies. A similar stitch joint error can be caused when the same nozzle firing sequence is used for each swath of a single die ejection head.

SUMMARY OF THE INVENTION

The stitch joint error can be reduced by firing the nozzles of adjacent dies in a multi-die ejection head using different firing sequences. Similarly, the nozzles of a single die ejection head can be fired using different sequences in adjacent swaths of the ejection head. By firing the nozzles in different sequences as discussed above, the drops at the stitch joint can be positioned closer to each other than they would be if the same firing sequence was used for each die/swath. By reducing the distance between the drops on either side of the stitch joint, the location of the stitch joint becomes less apparent.

When fabricating multi-die ejection heads, it is often difficult to precisely position adjacent dies so that, in the case of vertically positioned dies, the spacing between the lowermost nozzle of the upper die and the uppermost nozzle of the lower die is equal to the nozzle spacing of each die. As a result, it can be cost effective to overlap the dies and then select which nozzles will be used. For example, using the second or third nozzle from the upper edge of the lower die may result in a more proper spacing with relation to the lowermost nozzle of the upper die. Such die overlapping is another factor that must be considered when determining what firing sequence of the lower die results in the least amount of stitch joint error.

These and other features and advantages of the invention are described in or are apparent from the following detailed description of the exemplary embodiments.

BRIEF DESCRIPTION OF THE DRAWINGS

Various exemplary embodiments of the invention will be described in relation to the following drawings in which like reference numerals refer to like elements, and wherein:

FIG. 2 is one exemplary embodiment of a face of a print head of the invention;

FIG. 3 is another exemplary embodiment of a face of a print head of the invention;

FIG. 4 is one exemplary embodiment of a print head of the invention having two dies;

DETAILED DESCRIPTION OF EXEMPLARY EMBODIMENTS

One exemplary embodiment of a fluid ejection device according to this invention is an image recording apparatus having a print head movable in a first direction. Other embodiments of the image recording apparatus can have a print head movable in a first direction and a second direction opposite the first direction. In an image recording apparatus incorporating the systems and methods of this invention, a controller controls the firing and firing sequence of drops of a recording fluid such that a stitch joint error is reduced or eliminated.

Figure 1:
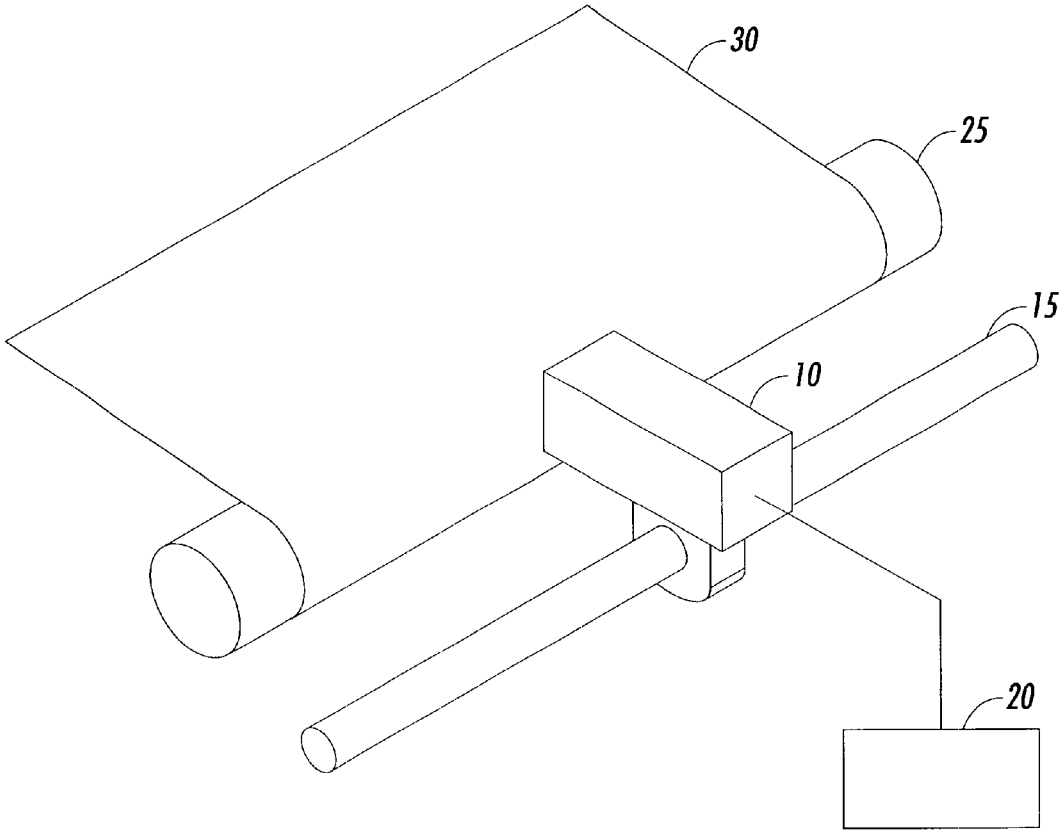
FIG. 1 is a perspective view of an exemplary image recording apparatus in which the systems and methods of the invention can be used.

FIG. 1 shows a portion of an image recording apparatus that incorporates the systems and methods of the invention. As shown in FIG. 1, a print head 10 slides in a first direction A along a guide rod 15. As the print head 10 moves back and forth, an image is recorded on a recording medium 30 which is supported by a platen 25. A controller 20 provides print information to the print head 10 to control the image printed by the print head 10.

FIG. 2 shows the face 1 1 of one exemplary embodiment of the print head 10. This exemplary embodiment of the print head 10 has one row of nozzles 40 on the face 11. FIG. 3 shows the face 12 of a second exemplary embodiment of the print head 10. This exemplary embodiment of the print head 10 has four rows of nozzles 40 on the face 12. FIG. 4 shows a print head 10 having a first die 50 and a second die 51. The face 13 of first die 50 and the face 14 of the second die 51 are each shown having one row of nozzles 40. FIGS. 2–4 are simply examples of many configurations of print heads usable with the systems and methods of the invention. The print head 10 could have any appropriate number of dies and any appropriate number of rows of nozzles or other configurations of nozzles controllable by the controller.

FIGS. 5–9 show dots of recording fluid, for example ink, on a recording medium. The horizontal placement of each dot of recording fluid is determined by the firing sequence of the nozzles of the print head. In FIGS. 5–9, the print head moves from left to right while firing the recording fluid. Therefore, the leftmost dot of the upper swath shown in each figure is the first dot fired in the sequence shown. The horizontal dotted line shown in FIGS. 5–9 represents the stitch joint between two swaths of a print head or between two dies of a multi-die print head.

In some print heads, the nozzles are fired in groups so that several nozzles in a particular print head will be fired simultaneously. In ink jet printing, simultaneously firing two adjacent nozzles can cause ink drop interactions that result in a degraded image. For the purpose of explaining examples of the systems and methods of this invention, a print head will be used that fires its nozzles in four groups. For example, if the print head has 80 nozzles, there will be four firing events, each containing 20 nozzles fired simultaneously. In this example, if the nozzles are numbered sequentially 1–80, nozzles 1, 5, 9, 13 . . . 77 will be fired simultaneously, nozzles 2, 6, 10, 14 . . . 78 will be fired simultaneously, nozzles 3, 7, 11, 15 . . . 79 will be fired simultaneously, and nozzles 4, 8, 12, 16 . . . 80 will be fired simultaneously.

One example of firing sequences of the groups of nozzles is known as "4-ripple". In the 4-ripple firing mode, there are four sequences in which the group of nozzles can be fired. Each sequence is referred to as a "state", with the state being determined by the first nozzle fired. State 1 is the sequence 1-3-2-4, state 2 is the sequence 2-4-1-3, state 3 is the sequence 3-1-4-2, and state 4 is the sequence 4-2-3-1. All of these firing states avoid the nearest neighbor interaction of simultaneously fired adjacent nozzles.

Figure 5:
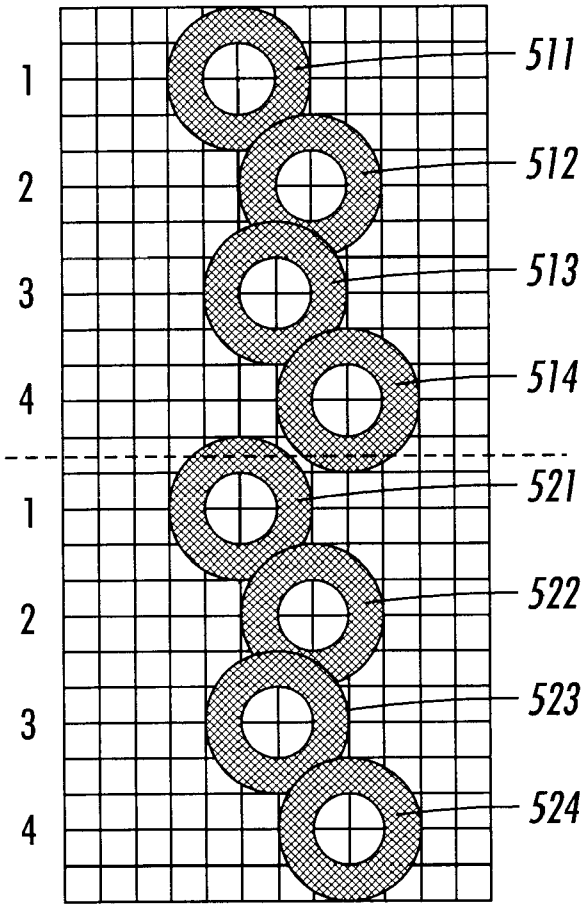
FIG. 5 shows stitch joint error without using the invention.

In the case of multiple die print heads in which the dies are oriented along a direction perpendicular to the direction of travel of the print head, and in the case of a single die print head that prints in only one direction, a significant systematic stitch error results if the adjacent dies or swaths are fired in the same state. FIG. 5 shows this condition. In FIG. 5, a first dot 511, a second dot 512, a third dot 513 and a fourth dot 514 are fired from a first die or during a first swath. A fifth dot 521, a sixth dot 522, a seventh dot 523 and an eighth dot 524 are fired from a second die located adjacent to and below the first die or during a second swath. Both the first die and the second die, or the single die in the first and second swaths, are fired in state 1 (1-3-2-4) as evidenced by the relative horizontal location of the dots in FIG. 5. The gap between fourth dot 514 and fifth dot 521 is the systematic stitch error caused by firing the first die and the second die, or the single die in the first and second swaths, in the same state. This firing mode stitch error is compounded by any die-die stitch error resulting from die-die x axis misplacement. The misplacement of adjacent dies often results from manufacturing tolerances.

Figure 6:
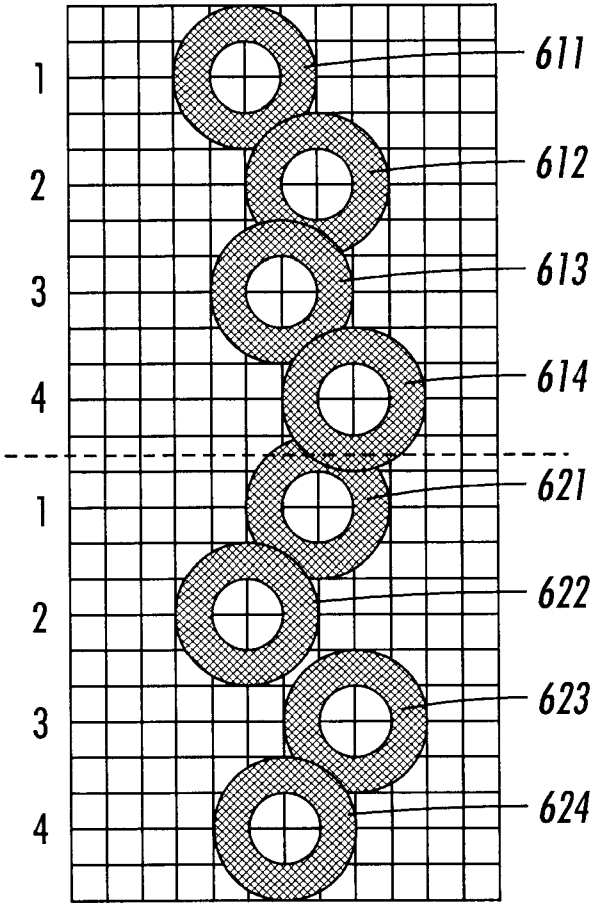
FIG. 6 shows one example of reduced stitch joint error using the invention.

The systems and methods of this invention reduce the stitch joint error by selecting different firing states for each adjacent die or each adjacent swath of a single die print head. FIG. 6 shows an example of the invention in which the second die or the second swath is in state 2 (2-4-1-3). FIG. 6 shows that changing the state of the second die or the second swath can minimize the firing order stitch error so that a significant error is not systematically added to any die-die stitch error that exists at the stitch line between the two dies. In FIG. 6, a first dot 611, a second dot 612, a third dot 613 and a fourth dot 614 correspond to the first-fourth dots 511–514 of FIG. 5 because the first die in FIG. 6 is in state 1 (1-3-2-4). However, the second die or the second swath in FIG. 6 is in state 2 (2-4-1-3), as shown by the horizontal placement of a fifth dot 621, a sixth dot 622, a seventh dot 623 and an eighth dot 624.

The appropriate state for the second die or the second swath is determined by the state of the first die or the first swath. The appropriate state for the second die or the second swath for each possible state of the first die or the first swath can be stored, for example, in a look-up table to be referenced by the controller 20 during printing.

The procedure described with reference to FIG. 6 is sufficient for a single die print head or if the first and second dies are precisely aligned such that the lowermost nozzle of the first die and the uppermost nozzle of the second die are spaced correctly with relation to the spacing of the other nozzles within each of the first and second dies. However, due to, for example, manufacturing expense and limitations, the first and second dies can be overlapped and a nozzle other than the uppermost nozzle of the second die selected as the uppermost firing nozzle of the second die. In other words, the uppermost one or more nozzles of the second die may not be used. Such overlapping avoids the requirement for precision assembly because misalignment between the two dies can be limited to one-half of the center-to-center nozzle spacing by selecting the optimum uppermost firing nozzle. In addition, nozzle selection can be made to result in a sub-pixel error, i.e., a paper under-advance error, rather than an error greater than a pixel, i.e., a paper over-advance error. This is desirable because paper under-advance of a given magnitude is much less noticeable than paper overadvance of the same magnitude.

However, the combination of the 4-ripple firing scheme and die overlapping can result in an additional source of stitch joint error if not compensated for.

Figure 7:
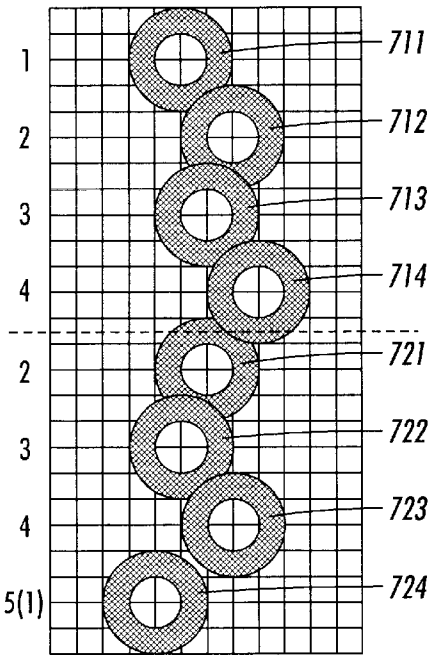
FIG. 7 shows one example of reduced stitch joint error using the invention with overlapping dies.

FIG. 7 shows an example in which the first die is in state 1 (1-3-2-4) as evidenced by the horizontal location of a first dot 711, a second dot 712, a third dot 713 and a fourth dot 714. The second die in FIG. 7 overlaps the first die such that the second nozzle is selected as the uppermost firing nozzle of the second die. This overlap and first-firing nozzle selection is indicated by the number 2 to the left of a fifth dot 721 in FIG. 7. Similarly, a sixth dot 722 is fired from the third nozzle of the second die, a seventh dot 723 is fired from the fourth nozzle of the second die and an eighth dot 724 is fired from the fifth nozzle of the second die. As discussed earlier, in this example, the nozzles of each die are fired in four groups, the first group containing nozzles 1, 5, 9 . . . 77. As a result, if a die is fired in state 1 all of the nozzles in the first group are the first nozzles fired in that die. Because FIG. 7 shows only the four uppermost fired nozzles of the second die and because the uppermost nozzle of the second die is not fired in this overlap situation, the eighth dot 724 is shown as being fired from the fifth nozzle. Because the fifth nozzle belongs to the first group of nozzles fired in state 1, it is the leftmost dot of the dots fired from the second die in FIG. 7. Although the second die in FIG. 7 is fired in state 1, similarly to the second die in FIG. 5, the fifth-eighth dots 721–724 in FIG. 7 appear in a different pattern than fifth-eighth dots 521–524 in FIG. 5. This is because the uppermost fired nozzle of the first group of nozzles in FIG. 7 (1, 5, 9, 13 . . . 77) is the fifth nozzle, whereas it is the uppermost, or first, nozzle in FIG. 5.

As can be seen from the preceding discussion, die overlapping, and the resulting selection of the uppermost fired nozzle, can change which state of the second die is most appropriate for reducing stitch joint error.

Figure 9:
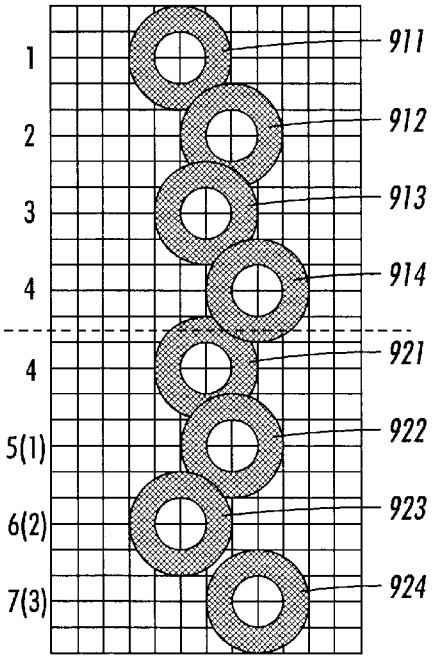
FIG. 9 shows another example of reduced stitch joint error using the invention with overlapping dies.
Figure 8:
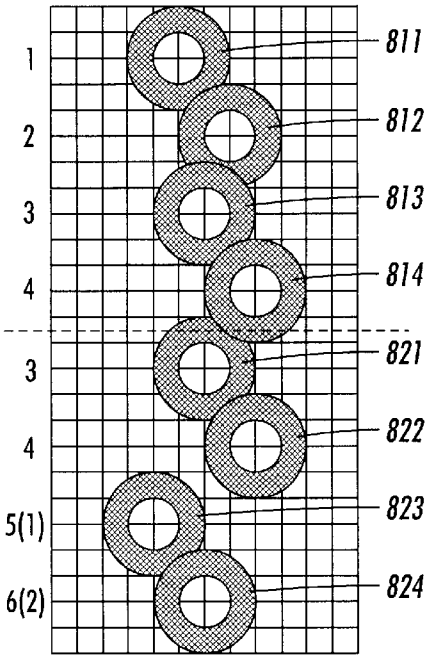
FIG. 8 shows another example of reduced stitch joint error using the invention with overlapping dies.

FIGS. 8 and 9 are other examples, similar to FIG. 7, of overlapped dies in which the third uppermost nozzle and fourth uppermost nozzle, respectively, are chosen as the uppermost fired nozzle. FIG. 8 shows a first dot 811, a second dot 812, a third dot 813 and a fourth dot 814 fired from the first die in state 1 (1-3-2-4). In FIG. 8, the third nozzle of the second die has been chosen as the uppermost firing nozzle. As a result, a fifth dot 821 is fired from the third nozzle, a sixth dot 822 is fired from the fourth nozzle, a seventh dot 823 is fired from the fifth nozzle and an eighth dot 824 is fired from the sixth nozzle of the second die. The second die in FIG. 8 is fired in state 1 as evidenced by the fifth nozzle (the uppermost fired nozzle in the first group of nozzles) being the first nozzle fired. FIG. 9 is similar to FIGS. 7 and 8 except that the fourth nozzle of the second die is the uppermost fired nozzle of the second die and the second die is in state 2 (2-4-1-3). In FIG. 9, a first dot 911, a second dot 912, a third dot 913 and a fourth dot 914 correspond to the first-fourth dots 811–814 of FIG. 8. The firing state (state 2) of the second die in FIG. 9 is indicated by the relative horizontal position of a fifth dot 921, a sixth dot 922, a seventh dot 923 and an eighth dot 924. Specifically, state 2 is indicated because the seventh dot 923 fired from the sixth nozzle, i.e., the uppermost fired nozzle of the second group of nozzles (2, 6, 10, 14 . . . 78) of the second die, is fired first.

FIGS. 6–9 show examples of appropriate states of the first and second dies when the uppermost fired nozzle of the second die is the first, second, third or fourth nozzle, respectively, of the second die when the first die is in state 1. It will be apparent that other combinations of the first die state and the uppermost fired nozzle of the second die will result in different optimum states for the second die. As discussed above, the optimum state of the second die for each possible condition can be stored, for example, in a look-up table in the controller.

Figure 10:
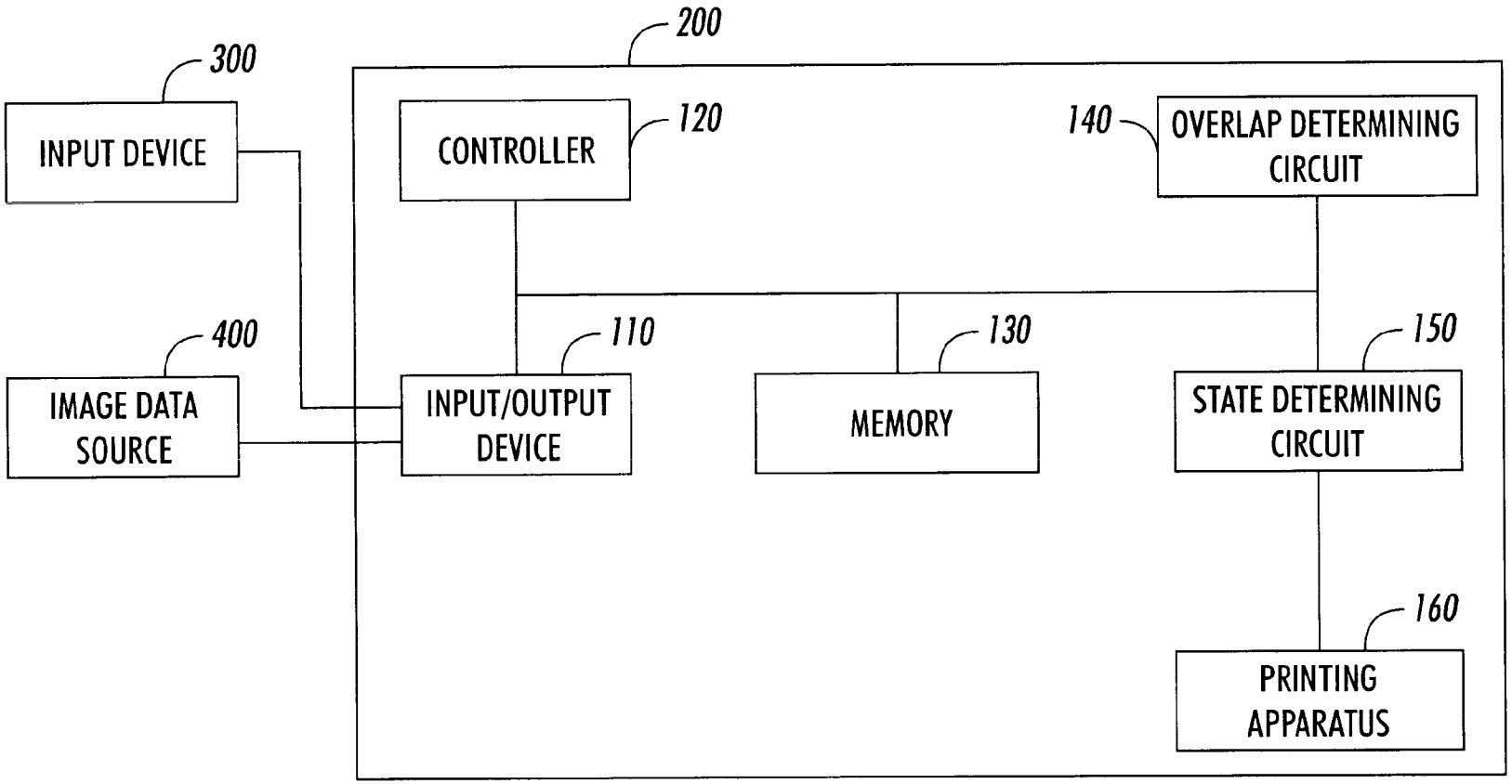
FIG. 10 is a functional block diagram of an exemplary embodiment of the invention.

FIG. 10 is a functional block diagram of one exemplary embodiment of a printing device 200 incorporating the systems and methods of the invention. The printing device 200 has an input/output device 110 that connects the printing device 200 to an input device 300, such as, for example, a keyboard or interactive display, and an image data source 400 such as, for example, a computer. In general, the image data source 400 can be any one of a number of different sources, such as a scanner, a digital copier, a facsimile device that is suitable for generating electronic image data, or a device suitable for storing and/or transmitting electronic image data, such as a client or server of a network, or the Internet, and especially the World Wide Web. For example, the image data source 400 may be a scanner, or a data carrier such as a magnetic storage disk, CD-ROM or the like, or a host computer, that contains image data. Thus, the image data source 400 can be any known or later developed source that is capable of providing image data to the printing device 200 of this invention.

When the image data source 400 is a personal computer, the data line connecting the image data source 400 to the printing device 200 can be a direct link between the personal computer and the printing device 200. The data line can also be a local area network, a wide area network, the Internet, an intranet, or any other distributed processing and storage network. Moreover, the data line can also be a wireless link to the image data source 400. Accordingly, it should be appreciated that the image data source 400 can be connected using any known or later developed system that is capable of transmitting data from the image data source 400 to the printing device 200.

The input/output device 110, a memory 130, an overlap determining circuit 140, and a state determining circuit 150 communicate over a data/control bus with a controller 120. The overlap determining circuit 140 determines a degree of overlap of the second print head in order to select the most appropriate uppermost fired nozzle of the second print head. The state determining circuit 150 determines which state is most appropriate to produce the minimum stitch joint error. The appropriate state is then supplied to a printing apparatus 160. The printing apparatus 160 can include, for example, the print head.

It should be understood that each of the circuits shown in FIG. 10 can be implemented as portions of a suitably programmed general purpose computer. Alternatively, each of the circuits shown in FIG. 10 can be implemented as physically distinct hardware circuits within an ASIC, or using a FPGA, a PDL, a PLA or a PAL, or using discrete logic elements or discrete circuit elements. The particular form each of the circuits shown in FIG. 10 will take is a design choice and will be obvious and predicable to those skilled in the art.

Figure 11:
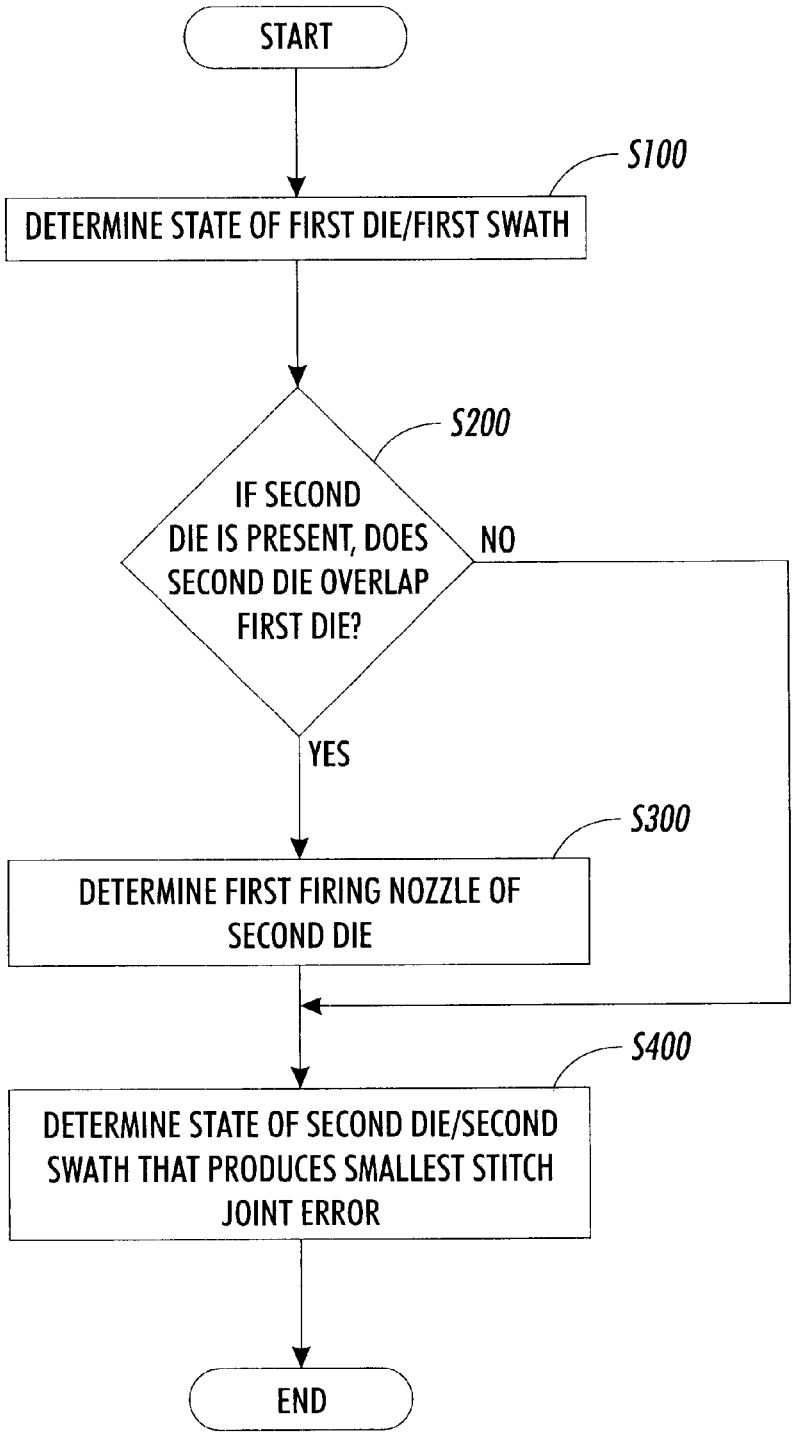
FIG. 11 is a flowchart showing a process of a controller of the invention.

FIG. 11 is a flow chart showing one example of a process of the invention. In step S100, a state of the first die (or first swath if a single die print head is used) is determined. If it is determined in step S200 that a second die is present and that the second die overlaps the first die, processing proceeds to step S300. If not, processing jumps directly to step S400. In step S300, the first nozzle of the second die is determined based on which nozzle of the second die provides the proper spacing relative to the lowermost nozzle of the first die. In step S400, the state of the second die that produces the smallest stitch joint error is determined based on the state of the first die and possibly on the determined uppermost fired nozzle of the second die.

As shown in FIG. 10, the printing device 200 is preferably implemented on a programmed general purpose computer. However, the printing device 200 can also be implemented on a special purpose computer, a programmed microprocessor or microcontroller and peripheral integrated circuit elements, an ASIC or other integrated circuit, a digital signal processor, a hardwired electronic or logic circuit such a discrete element circuit, a programmable logic device such as a PLD, PLA, FPGA or PAL, or the like. In general, any device, capable of implementing a finite state machine that is in turn capable of implementing the flow chart shown in FIG. 11, can be used to implement the printing device 200.

While the systems and methods of the invention have been explained with relation to a print head having a row of nozzles that are sequentially fired in groups, the nozzles of each particular group being fired simultaneously, the systems and methods of the invention are also applicable to other types of printing systems. For example, printing systems as shown in U.S. Pat. No. 5,675,365, incorporated herein by reference, can benefit from the invention by scheduling the activation of specific ejectors such that the stitch joint error is reduced or eliminated.

Further, while the systems and methods of the invention have been explained using four groups of 20 nozzles each, the systems and methods of the invention are also applicable to image forming systems and methods using any number of nozzles and any number of groups. In addition, while one skilled in the art of printing will apply the systems and methods of the invention to printing with ink, it is noted that the systems and methods of the invention apply to fluids other than ink.

In some exemplary embodiments of the invention, an alignment procedure where the user is allowed to choose from the best aligned of a series of vertical lines can be performed to determine the best print head states for a particular print head.

While the invention has been described in conjunction with the specific embodiments outlined above, it is evident that many alternatives, modifications and variations will be apparent to those skilled in the art. Accordingly, the exemplary embodiments of the invention as set forth above are intended to be illustrative and not limiting. Various changes may be made without departing from the spirit and scope of the invention as described herein.

What is claimed is:

1. A method of ejecting a fluid at a medium, the method comprising:

moving an ejection head, the ejection head having a first die, the first die having a first plurality of nozzles for firing drops of the fluid at the medium;

firing a first plurality of drops of the fluid at the medium from the first plurality of nozzles in a first firing sequence while the ejection head moves relative to the medium; and firing a second plurality of drops of the fluid at the medium from one of the first plurality of nozzles and a second plurality of nozzles, the second plurality of nozzles being in a second die of the ejection head, the second plurality of drops being fired in a second sequence different from the first sequence while the ejection head moves relative to the medium, wherein a drop of the first plurality of drops is adjacent a drop of the second plurality of drops, the adjacent drops fired at different times; and a stitch error between the drop of the first plurality of drops and the drop of the second plurality of drops is smaller than if the second sequence equals the first sequence.

2. The method of claim 1, wherein the ejection head is a print head.

3. The method of claim 1, wherein the second sequence is determined based on the first sequence.

4. The method of claim 1, wherein the first plurality of drops are fired during a first pass of the ejection head, and the second plurality of drops are fired from the first plurality of nozzles during a second pass of the ejection head after the first pass of the ejection head.

5. The method of claim 4, wherein the first pass overlaps the second pass.

6. The method of claim 4, wherein the first sequence is a first state of a firing mode and the second sequences a second state of the firing mode.

7. The method of claim 1, wherein the first plurality of drops are fired during a first pass of the ejection head, and the second plurality of drops are fired from the second plurality of nozzles during the first pass of the ejection head.

8. The method of claim 7, wherein the first sequence is a first state of a firing mode and the second sequence is a second state of the firing mode.

9. The method of claim 7, wherein the first plurality of nozzles and the second plurality of nozzles overlap and the second drop of the second plurality of drops is fired from a nozzle other than a peripheral nozzle of the second plurality of nozzles.

10. A fluid ejecting apparatus, comprising:

an ejection head having a first die, the first die having a first plurality of nozzles for firing drops of a fluid at a medium; and a controller that controls the firing of the drops of the fluid such that a first plurality of drops of the fluid are fired at the medium from the first plurality of nozzles in a first firing sequence while the ejection head moves relative to the medium;

a second plurality of drops of the fluid are fired at the medium in a second firing sequence while the ejection head moves relative to the medium;

a drop of the first plurality of drops is adjacent a drop of the second plurality of drops, the adjacent drops fired at different times; and a stitch error between the drop of the first plurality of drops and the drop of the second plurality of drops is smaller than if the second sequence equals the first sequence.

11. The fluid ejecting apparatus of claim 10, wherein the ejection head is a print head.

12. The fluid ejecting apparatus of claim 10, wherein the controller further controls the firing of the drops of fluid such that the second sequence is determined based on the first sequence.

13. The fluid ejecting apparatus of claim 10, wherein the controller further controls the firing of the drops of fluid such that the first plurality of drops are fired during a first pass of the ejection head, and the second plurality of drops are fired from the first plurality of nozzles during a second pass of the ejection head after the first pass of the ejection head.

14. The fluid ejecting apparatus of claim 10, wherein the controller further controls the firing of the drops of fluid such that the first sequence is a first state of a firing mode and the second sequence is a second state of the firing mode.

15. The fluid ejecting apparatus of claim 10, wherein the ejection head further comprises a second die, the second die having a second plurality of nozzles for firing drops of the fluid at the medium, the second plurality of nozzles firing the second plurality of drops.

16. The fluid ejecting apparatus of claim 15, wherein the first sequence is a first state of a firing mode and the second sequence is a second state of the firing mode.

17. The fluid ejecting apparatus of claim 15, wherein the first plurality of nozzles and the second plurality of nozzles overlap and the drop of the second plurality of drops is fired from a nozzle other than a peripheral nozzle of the second plurality of nozzles.

18. A fluid ejecting apparatus, comprising:

means for moving an ejection head, the ejection head having a first die, the first die having a first plurality of nozzles for firing drops of a fluid at a medium;

means for firing a first plurality of drops of the fluid at the medium from the first plurality of nozzles in a first firing sequence while the ejection head moves relative to the medium; and means for firing a second plurality of drops of the fluid at the medium from one of the first plurality of nozzles and a second plurality of nozzles, the second plurality of nozzles being in a second die of the ejection head, the second plurality of drops being fired in a second sequence different from the first sequence while the ejection head moves relative to the medium, wherein a drop of the first plurality of drops is adjacent a drop of the second plurality of drops, the adjacent drops fired at different times; and a stitch error between the drop of the first plurality of drops and the drop of the second plurality of drops is smaller than if the second sequence equals the first sequence.

* * * * *